US007719474B2

(12) United States Patent
Chou

(10) Patent No.: US 7,719,474 B2
(45) Date of Patent: May 18, 2010

(54) ANTENNA STRUCTURE WITH FIXING UNIT

(75) Inventor: Chih-Shen Chou, Miaoli County (TW)

(73) Assignee: Unictron Technologies Corporation, Hsin-Chu (TW)

( * ) Notice: Subject to any disclaimer, the term of this patent is extended or adjusted under 35 U.S.C. 154(b) by 222 days.

(21) Appl. No.: 12/139,501

(22) Filed: Jun. 15, 2008

(65) Prior Publication Data

US 2009/0179811 A1 Jul. 16, 2009

(30) Foreign Application Priority Data

Jan. 10, 2008 (TW) ..... 97101004 A

(51) Int. Cl.
*H01Q 1/24* (2006.01)

(52) U.S. Cl. ..... 343/702; 343/905

(58) Field of Classification Search ..... 343/702, 343/878, 905, 906
See application file for complete search history.

(56) References Cited

U.S. PATENT DOCUMENTS

2007/0273598 A1* 11/2007 Kuroda et al. ..... 343/753
2008/0165067 A1* 7/2008 Kim ..... 343/702

* cited by examiner

*Primary Examiner*—Hoang V Nguyen
(74) *Attorney, Agent, or Firm*—Winston Hsu

(57) ABSTRACT

An antenna structure includes a substrate, a signal transmission unit and at least one fixing unit. The substrate is made of a dielectric material and has at least a through hole. The signal transmission unit has a transmission path and goes through the through hole. The fixing unit is made of a flexible or deformable material, and is in contact with the signal transmission unit and the inner surface of the through hole to fix the signal transmission unit on the substrate.

18 Claims, 4 Drawing Sheets

ANTENNA STRUCTURE WITH FIXING UNIT

BACKGROUND OF THE INVENTION

1. Field of the Invention

The present invention relates to an antenna structure, and more particularly, to an antenna structure comprising a fixing unit. The fixing unit is in contact with a signal transmission unit and a hole of a substrate to fix the signal transmission unit on the substrate.

2. Description of the Prior Art

Please refer to FIG. 1. FIG. 1 is a diagram illustrating a typical patch antenna 100. As shown in FIG. 1, the patch antenna 100 includes a substrate 110 and a metal stick 120. The substrate 110 is made of a dielectric material, such as ceramic. The top surface and the bottom surface of the substrate 110 are both coated with metal to act as a radiation electrode 112 and a ground electrode 114 respectively. In addition, the substrate 110 also has a through hole 116. The metal stick 120 is disposed in the through hole 116 to connect the radiation electrode 112 with a signal processing device (not shown in FIG. 1).

However, a slight difference in the relative position of the metal stick on the substrate may result in variations in antenna characteristics, such as resistance, frequency, and the degree of circular polarization. Therefore, in the mass production of patch antenna, the manufacturing variations of the inner diameters of the through holes and the outer diameters of the metal sticks, as well as the relative shifting of the metal position during assembly would result in a wide distribution in their characteristics.

SUMMARY OF THE INVENTION

It is therefore one of the objectives of the present invention to provide an antenna structure with a fixing unit to reduce the characteristic variations of the patch antenna caused by the distribution in position of the metal sticks on the substrate, resulting from variation of the diameters of metal sticks and through holes, as well as the relative position of each metal stick placed inside the through holes.

According to an exemplary embodiment of the claimed invention, an antenna structure is disclosed. The antenna structure comprises: a substrate, which is made of a dielectric material and has at least a through hole; a signal transmission unit, which has a transmission path and goes through the through hole; and at least a fixing unit, which is made of a flexible or deformable material. The fixing unit is in contact with the surface of the signal transmission unit and the inner surface of the through hole to fix the signal transmission unit on the substrate.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
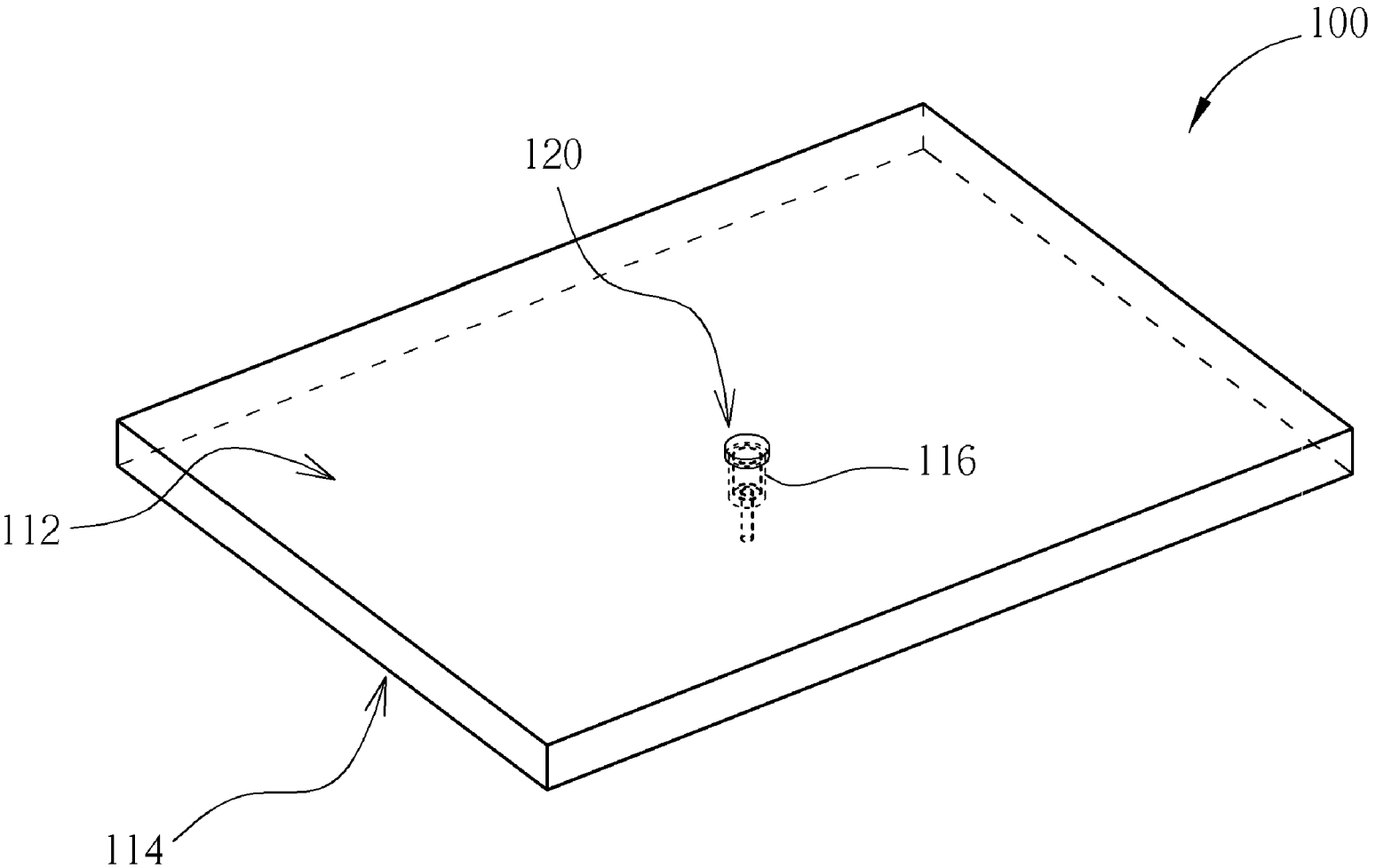
FIG. 1 PRIOR ART
FIG. 1 is a diagram illustrating a typical patch antenna.

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "electrically connect" is intended to mean either an indirect or direct electrical connection. Accordingly, if one device is coupled to another device, that connection may be through a direct electrical connection, or through an indirect electrical connection via other devices and connections.

Different features of the present invention are detailed as below with reference to the figures, and for convenience of explanation, the same elements in separate figures are indicated by the same reference numerals.

Figure 2:
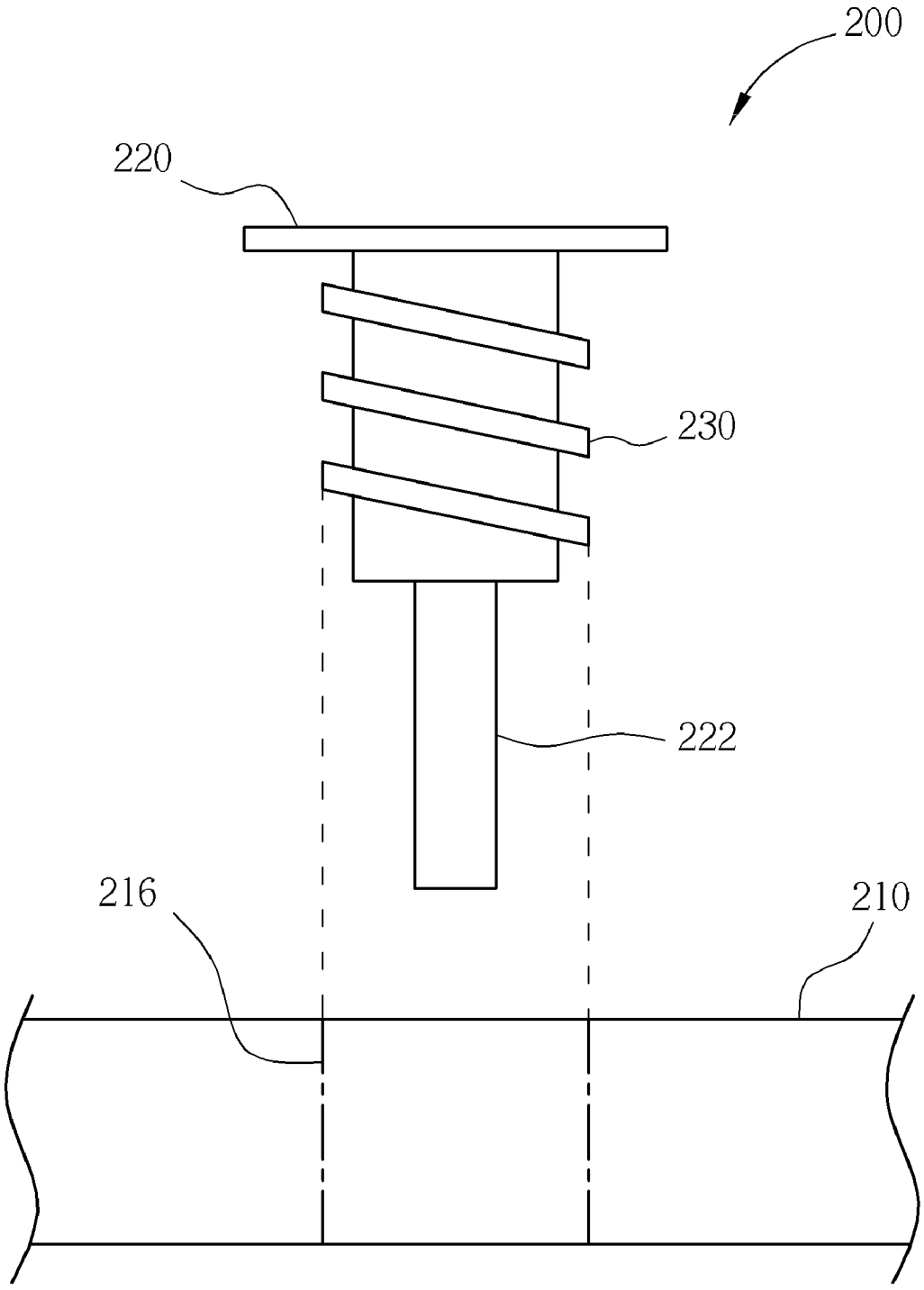
FIG. 2 is a schematic diagram illustrating an antenna structure according to a first embodiment of the present invention.

Please refer to FIG. 2. FIG. 2 is a schematic diagram illustrating an antenna structure 200 according to a first embodiment of the present invention. To make the concept of the present invention easily appreciable, the antenna structure 200 is assumed to be a patch antenna in this embodiment; this is, however, for illustrative purposes and not a limitation of the prevent invention. As shown in FIG. 2, the antenna structure 200 comprises a substrate 210, a signal transmission unit 220 and a fixing unit 230. The substrate 210 is made of a dielectric material and has a through hole 216. The signal transmission unit 220 has a transmission path 222 and goes through the through hole 216. The fixing unit 230 is in contact with the signal transmission unit 220 and the through hole 216 to fix the signal transmission unit 220 on the substrate 210, and fixes the position of the signal transmission unit 220 in the through hole 216. In this embodiment, the substrate 210 of the antenna structure 200 is made of a ceramic material (i.e., the antenna structure 200 is a ceramic patch antenna); this is, however, for illustrative purposes and not a limitation of the prevent invention. For instance, the substrate can be made of a glass material, a polymer material, a magnetic material or a compound material comprising at least one of the above-mentioned dielectric materials.

As shown in FIG. 2, the through hole 216 is a circular through hole, the signal transmission unit 220 is a metal stick, and the fixing unit 230 is a screw thread on a surface of the signal transmission unit 220. The outer diameter of the screw thread (230) is approximately equal to the inner diameter of the circular through hole (216). The metal stick (220) and the screw thread (230) are both made of copper and are formed in whole (as one piece). Since copper has good malleability, the screw thread (230) can help to fix the position of the metal stick (220) in the circular through hole (216) for ensuring every produced patch antenna has identical characteristics, such as resistance, frequency, circular polarization degree and so on.

Figure 3:
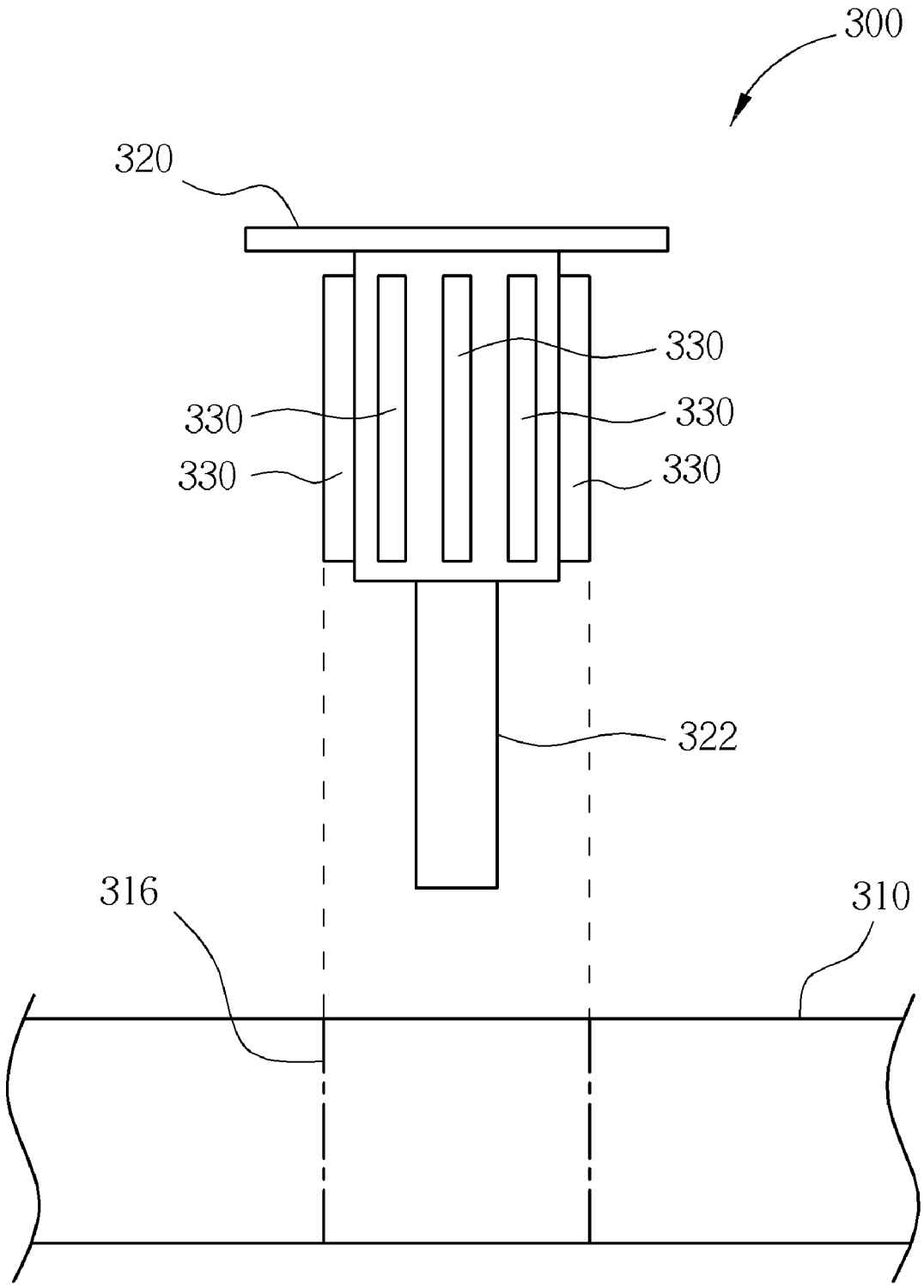
FIG. 3 is a schematic diagram illustrating an antenna structure according to a second embodiment of the present invention.

In the above embodiment, the fixing unit 230 is a spiral fixing unit on the surface of the signal transmission unit 220 (i.e., the screw thread); however, this is not a limitation of the present invention. In practice, the fixing unit can be a unit of any shape, protruding from the signal transmission unit (e.g., a circular protruded unit or a bar protruded unit). In addition, the antenna structure is not limited to only one fixing unit; in other words, the antenna structure can comprise a plurality of fixing units. Take FIG. 3 for example. FIG. 3 is a schematic diagram illustrating an antenna structure 300 according to a second embodiment of the present invention. As shown in FIG. 3, the antenna structure 300 comprises a plurality of fixing units 330, which are a plurality of bar protruding units on a surface of a signal transmission unit 320. Please note that the plurality of fixing units 330 are symmetrically disposed on the surface of the signal transmission unit 320 in this embodiment; however, this is not a limitation of the present invention. In another embodiment of the present invention, the plurality of protruding units on the signal transmission unit can be not symmetrical with respect to each other. As long as the positions of the plurality of protruding units on the surface of the signal transmission unit can match the shape of the through hole, to allow excellent position accuracy on the substrate, then good consistency in the antenna characteristics of the signal transmission unit can be achieved.

Figure 4:
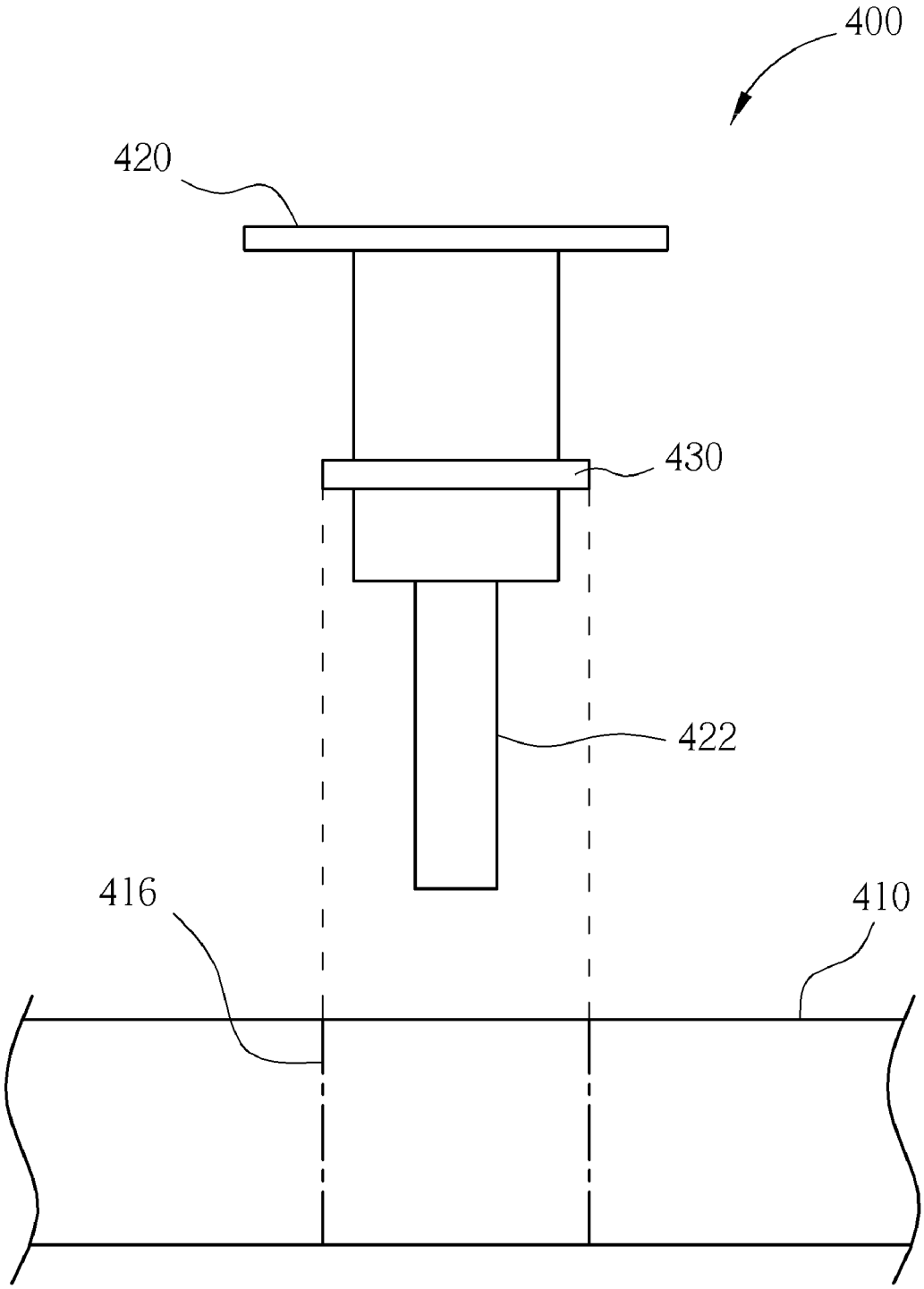
FIG. 4 is a schematic diagram illustrating an antenna structure according to a third embodiment of the present invention.

In the first embodiment of the present invention, the signal transmission unit 220 and the fixing unit 230 in the antenna structure 200 are formed in whole; this is, however, for illustrative purposes and not a limitation of the prevent invention. In other embodiments of the present invention, the signal transmission unit and the fixing unit can be two independent units respectively, and their materials can also be different from each other. In addition, the fixing unit 230 is made of copper; this is, however, for illustrative purposes and not a limitation of the prevent invention. In practice, the fixing unit can be made of a flexible or deformable material, such as metal, rubber, plastic or paper. Take FIG. 4 for example. FIG. 4 is a schematic diagram illustrating an antenna structure 400 according to a third embodiment of the present invention. The fixing unit 430 is a plastic washer that surrounds and contacts with the signal transmission unit 420, as shown in FIG. 4. The plastic washer (430) is able to transform properly to help fix the position of signal transmission unit 420 in the through hole 416.

In the first embodiment of the present invention, the fixing unit 230 is disposed on the surface of the signal transmission unit 220; this is, however, for illustrative purposes and not a limitation of the prevent invention. In other embodiments, the fixing unit(s) can be disposed only on the inner surface of the through hole or also on surfaces of the signal transmission unit. In addition, the through hole can comprise a groove corresponding to the fixing unit (e.g., the protruding unit) on its inner surface. The fixing unit (e.g., the protruding unit) on the signal transmission unit is mortised in the groove to help fix the signal transmission unit in the through hole. However, this is also not a limitation of the present invention. For example, the groove can be disposed only on the surface of the signal transmission unit or on both surfaces of the signal transmission unit and the through hole.

Those skilled in the art will readily observe that numerous modifications and alterations of the device and method may be made while retaining the teachings of the invention.

What is claimed is:

1. An antenna structure, comprising:

a substrate, made of a dielectric material, having at least a through hole;

a signal transmission unit, having a transmission path, going through the through hole; and at least a fixing unit, made of a flexible or deformable material;

wherein the fixing unit is in contact with a surface of the signal transmission unit and a surface of the through hole to fix the signal transmission unit on the substrate.

2. The antenna structure of claim 1, being a patch antenna.

3. The antenna structure of claim 1, wherein the fixing unit is a protruding unit.

4. The antenna structure of claim 3, wherein the fixing unit is a spiral fixing unit.

5. The antenna structure of claim 3, wherein the fixing unit is a circular fixing unit.

6. The antenna structure of claim 3, wherein the fixing unit is a bar fixing unit.

7. The antenna structure of claim 3, wherein the through hole comprises a concave hole corresponding to the fixing unit, and the fixing unit is mortised in the concave hole.

8. The antenna structure of claim 3, further comprising a plurality of protruding units on the surface of the signal transmission unit.

9. The antenna structure of claim 3, wherein the fixing unit and the signal transmission unit are formed in whole.

10. The antenna structure of claim 1, wherein the fixing unit is a protruding unit on the inner surface of the through hole.

11. The antenna structure of claim 10, wherein the signal transmission unit comprises a concave hole corresponding to the fixing unit, and the fixing unit is mortised in the concave hole.

12. The antenna structure of claim 10, further comprising a plurality of protruding units on the inner surface of the through hole.

13. The antenna structure of claim 10, wherein the fixing unit and the through hole are formed in whole.

14. The antenna structure of claim 1, wherein the fixing unit is made of metal, plastic, rubber or paper.

15. The antenna structure of claim 1, wherein the dielectric material of the substrate is a glass material or a ceramic material.

16. The antenna structure of claim 1, wherein the dielectric material of the substrate is a polymer material.

17. The antenna structure of claim 1, wherein the dielectric material of the substrate is a magnetic material.

18. The antenna structure of claim 1, wherein the dielectric material of the substrate is a compound material comprising at least one of glass, ceramic, polymer and magnetic materials.

* * * * *